US005934210A

United States Patent [19]

Lucchese

[11] Patent Number: 5,934,210

[45] Date of Patent: Aug. 10, 1999

[54] EMBROIDERY BOARD SUPPORTING HOOPS

[76] Inventor: Salvatore Lucchese, 1568 Hanna Rd., Valley Park, Mo. 63088

[21] Appl. No.: 09/042,984

[22] Filed: Mar. 17, 1998

[51] Int. Cl.[6] ..... D05C 9/04

[52] U.S. Cl. ..... 112/103; 38/102.2

[58] Field of Search ..... 112/103; 38/102, 38/102.2; 160/380; 269/47, 289 R, 303; 248/447, 448, 450, 451

[56] References Cited

U.S. PATENT DOCUMENTS

| | | | |
|---|---|---|---|
| 1,797,889 | 3/1931 | Wiberg . | |
| 4,292,748 | 10/1981 | Miller . | |
| 4,466,601 | 8/1984 | Raines . | |
| 4,545,127 | 10/1985 | Barry . | |
| 4,620,687 | 11/1986 | Bishop . | |
| 4,767,111 | 8/1988 | Guenther . | |
| 4,869,183 | 9/1989 | Moore, III | 112/103 |
| 5,144,899 | 9/1992 | Allen | 112/103 |
| 5,432,990 | 7/1995 | Seneff . | |
| 5,590,613 | 1/1997 | Head | 38/102.2 X |
| 5,664,350 | 9/1997 | Moore, III | 38/102.2 |

OTHER PUBLICATIONS

Letter Perfect Hooper,"," When It Comes To Hooping We're Perfect.

*Primary Examiner*—Ismael Izaguirre

*Attorney, Agent, or Firm*—Polster, Lieder, Woodruff & Lucchesi, L.C.

[57] ABSTRACT

Apparatus for promoting embroidery work on fabric such as clothing, comprising a board frame for receiving the fabric to be embroidered through the mounting of hoops on the board to prepare an area of the fabric for embroidery, and to boards being constructed to fit different sizes of fabric material.

7 Claims, 4 Drawing Sheets

EMBROIDERY BOARD SUPPORTING HOOPS

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

Mounting fabric in preparation for being embroidered requires hoop means which places the area of the fabric to be embroidered under tension to meet the requirement of what every type of machine is to be used to apply a desired design or lettering or art work to the fabric.

The prior art which relates to framing fabric for embroidery work includes such complicated apparatus as can be found in prior art patents such as U.S. Pat. Nos. 4,545,127 of Oct. 8, 1985; 4,561,177 of Dec. 31, 1985; 4,767,111 of Aug. 30, 1985; 5,432,990 of Jul. 18, 1995; and 4,805,297 of Feb. 21, 1989. These examples of the art require complicated apparatus for handling fabric to which embroidery designs are to be applied. The complication adds cost and requires individuals of mechanical ability.

In other words the embroidery hoop apparatus of the character found in the art is expensive and embodies complicated apparatus for accomplishing the end results in the field of embroidery work.

OBJECTS OF THE INVENTION

It is the desire to avoid complicated embroidery hoop apparatus by providing simple hoop supporting boards that offer a range of sizes of fabric all reduced to simple manipulation for supporting hoops at desired locations on fabric to suit a variety of embroidery machines.

A further object of the invention is to embody hoop apparatus for accommodating a variety of sizes of fabric items in a single board adapted to receive selected sizes of fabric items.

Another object of the invention is to provide a fabric supporting board that allows for selectivity of location of embroidery hoop to accommodate embroidery work suitable for children through adult sizes.

Yet another object of the invention is to provide a conventional size of board which is easily portable and does not require misshaping garments to accomplish the creation of designs suitable for embroidery work.

These and other objects pertaining to the important embroidery hoop apparatus will be apparent from the description of this invention.

BRIEF SUMMARY OF THE INVENTION

The invention comprises a board means for applying embroidery hoop means to a garment or fabric for framing the fabric to receive embroidery whereby the framed fabric can be removed from the board means and brought to a program driven embroidery machine so the embroidery work can be located on the fabric framed in the hoop means.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

Figure 1:
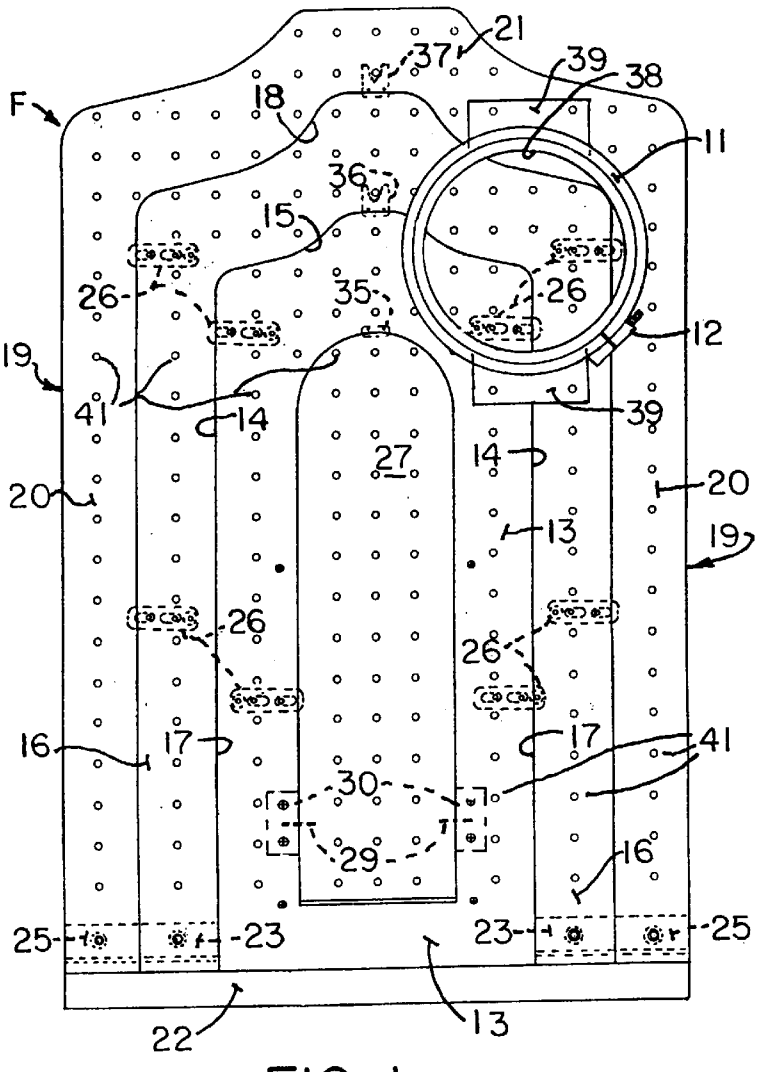
FIG. 1 is a plan view in slanted elevation of the hoop supporting board suitable for selective sizes of fabric.
Figure 8:
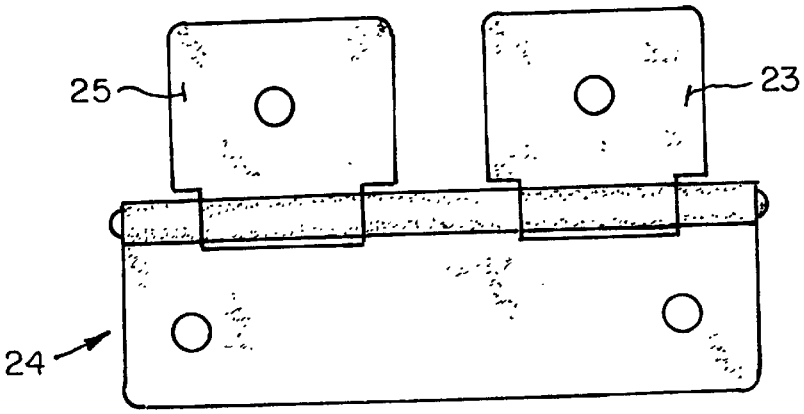
FIG. 8 is a plan view of the hinge of FIG. 7.
Figure 10:
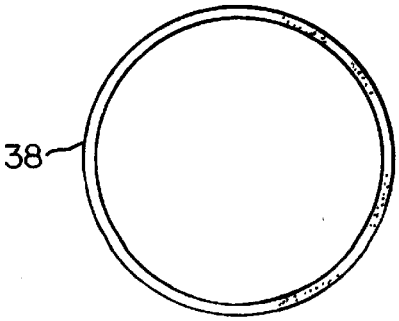
FIG. 10 is a view of a typical male hoop.

The view of FIG. 1 illustrates the adjustable female embroidery hoop having the size adjustment element 12 which is intended to accommodate fabric thickness in order to receive a male hoop seen in FIG. 10. The board of FIG. 1 is composed of a stationary central board 13 having a pair of straight outer edges 14 merging at the top in a shaped form 15. The stationary central board 13 is fitted to an inner hinged board 16 having a pair of straight legs with sides 17 and a connective top 18 following the shape of the top 15 for the stationary central board 13. The inner hinged board 16 is fitted with an outer board 19 having a pair of straight legs 20 connected by a formed top connection 21. The bottom ends of the inner board is connected to a base 22 by the hinge leaf 23 of a hinge plate 24 seen in FIG. 8. That hinge plate 24 has an outer leaf 25 attached to the bottom of the legs 20 of the outer board 19.

Figure 2:
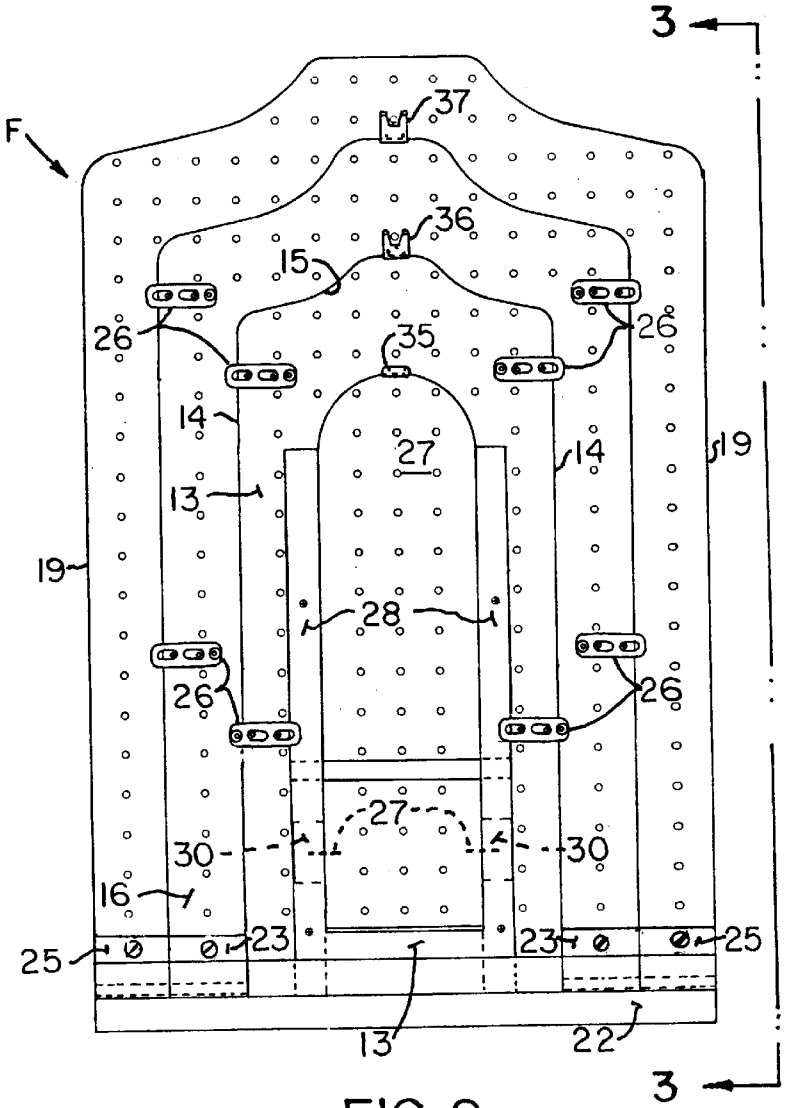
FIG. 2 is a back side of the hoop supporting board of FIG. 1.
Figure 6:
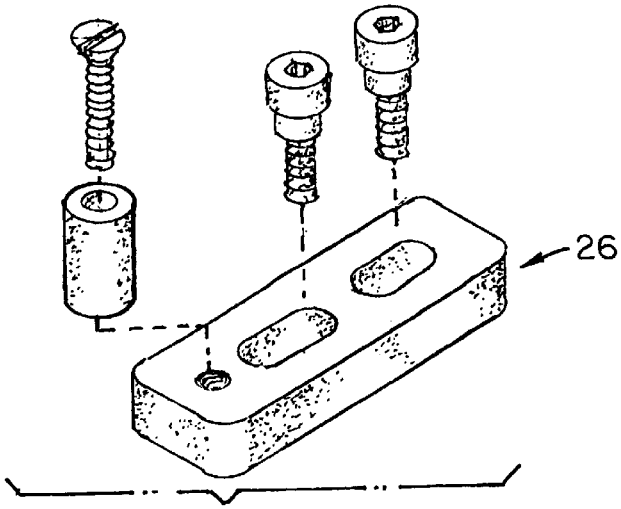
FIG. 6 is a perspective view of a typical board slidable support.
Figure 7:
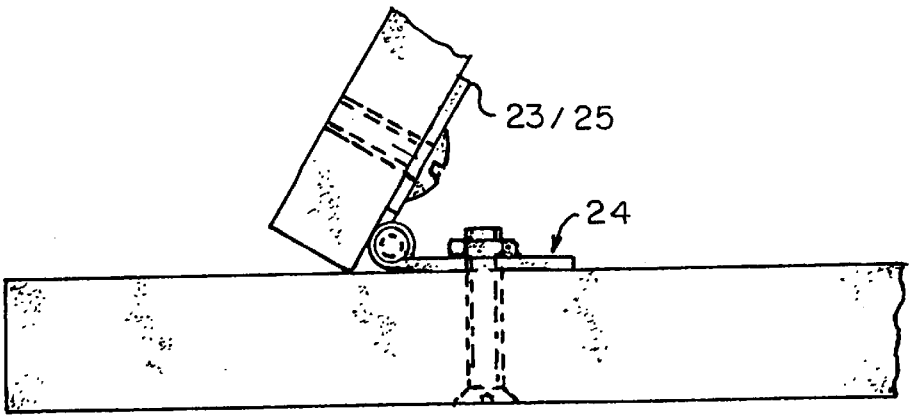
FIG. 7 is a fragmentary view of a typical hinge for the several boards.

As seen in FIGS. 1 and 2, the respective outer, inner and central boards are intended to line up in a common plane by the alignment slide blocks 26 (see FIG. 6) which are attached to the rear side of the several boards 13, 16 and 19. Since those boards are formed from a transparent sheet of plastic the slide blocks 26 can be seen in FIGS. 1 and 2.

The board assembly seen in FIGS. 1 and 2 are provided with a small fabric sleeve board 27 which is fitted between the support braces 28 for the adjacent larger board 13 which is not hinged. That board 13 is held in a slanted position (see FIGS. 3, 4 and 5) and is provided with a pair of aligned hinge pins 29 located by bearing plates 30 carried in the slanted surfaces of the braces 28. That fabric sleeve board swings on the pins 29 into frontal position relative to the slanted board assembly in FIG. 5. As the board swings out, its rear end 27A abuts a stationary stop rod 31 which limits the angle of projection. In addition to the abutment stop 31 there is provided a removable support element 32 (FIG. 5) which can be set in place on a pin 33, and when the board 27 is swung back into the plane of the other boards that support element 32 needs to be removed so it will not interfere with fabric slipped over the slanted boards.

Figures 3, 4:
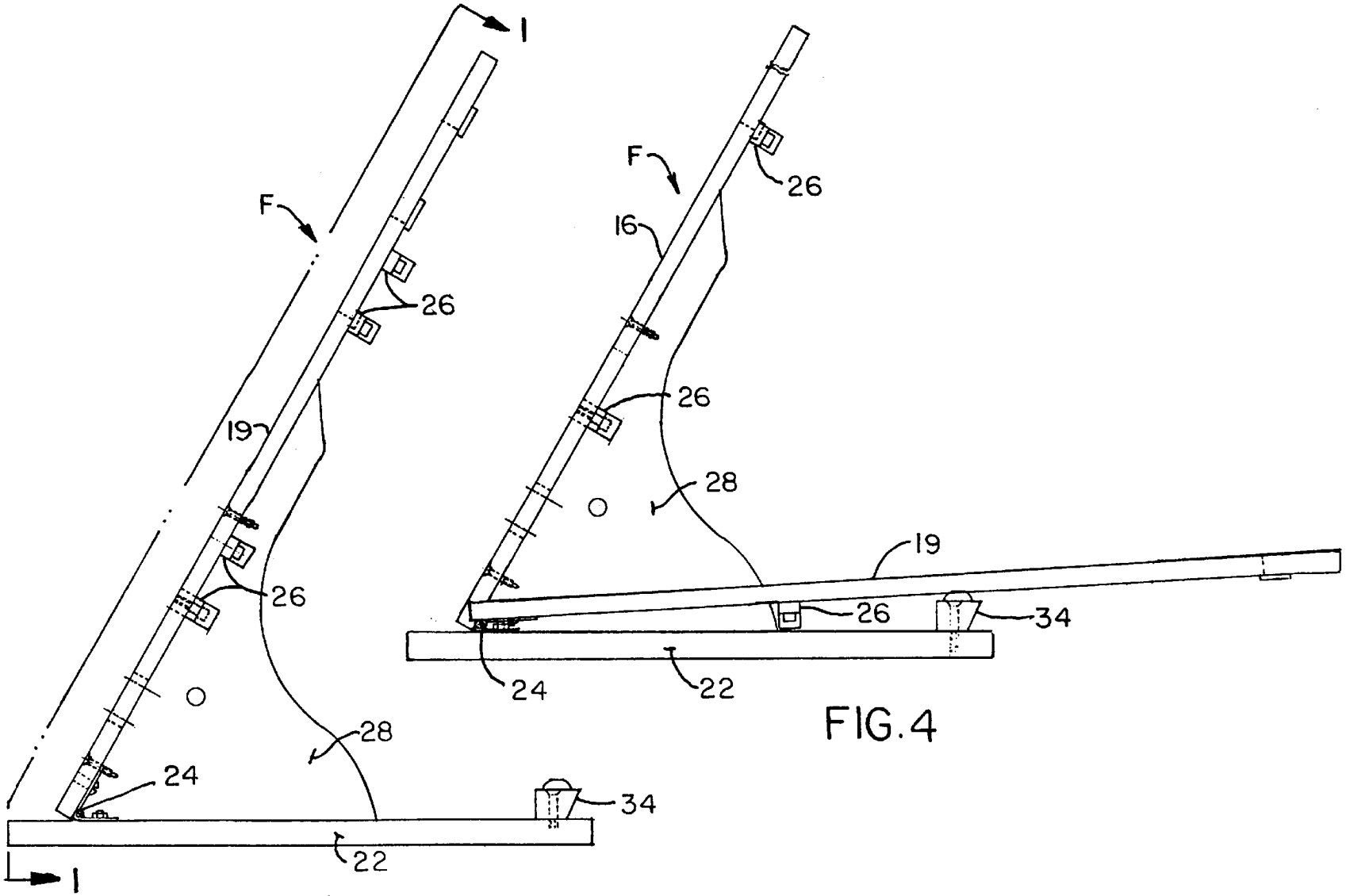
FIG. 3 is a side elevation taken along 3—3 in FIG. 2.
FIG. 4 is a side elevation of the board of FIG. 2 with one size board laid back to reduce the fabric size for the remaining board.
Figure 5:
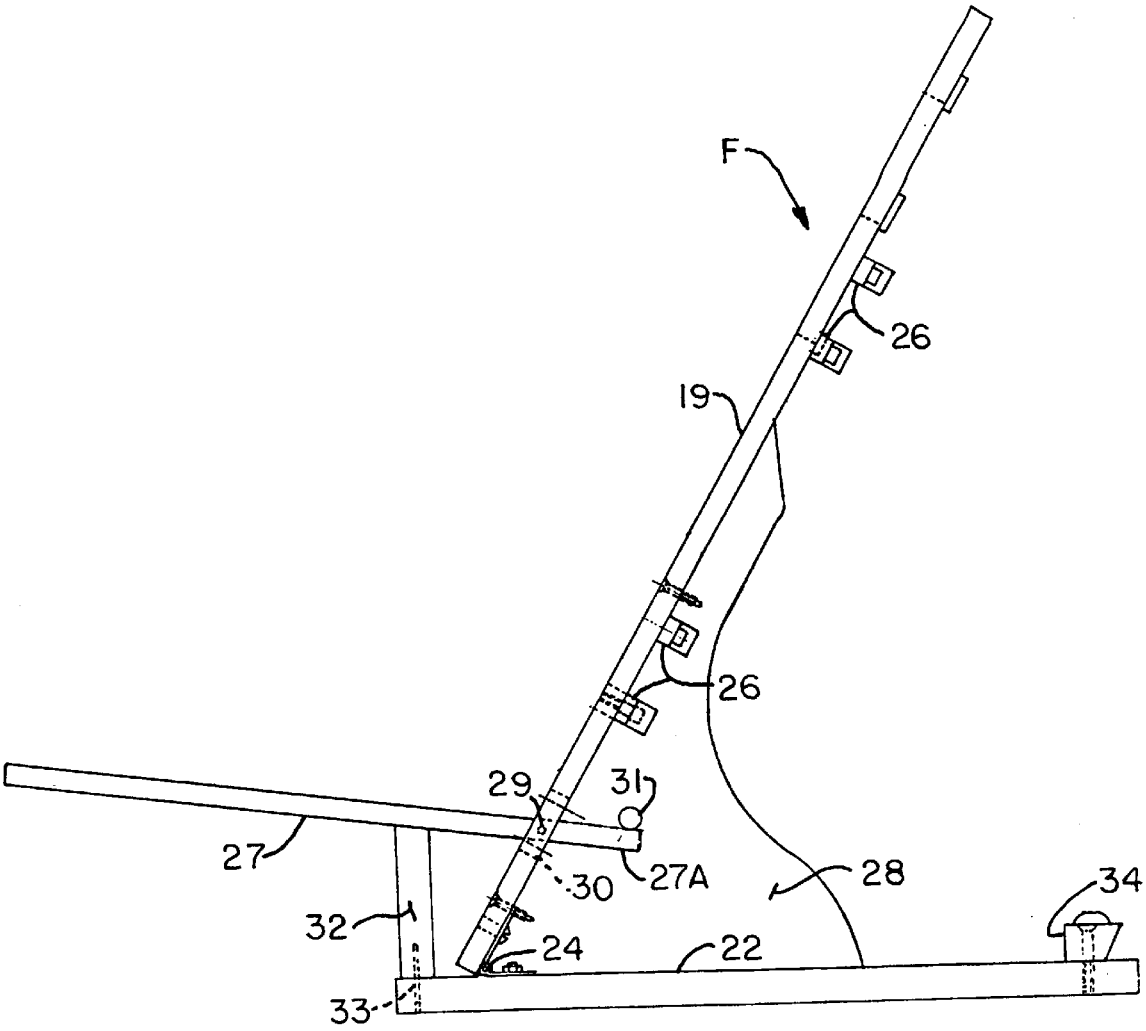
FIG. 5 is a side view of FIG. 2 with the central sleeve side board laid out from the board.

When it is necessary to hinge either of the boards 16 or 19 to a laid back position, as seen in FIG. 4, there is a support rod 34 positioned on the base 22. In order to be able to swing either or both of the boards 16 and 19 to a laid back position it is first necessary to slide the blocks 26 inwards so the edges of the boards 16 or 19 clear the blocks 26. But when the boards 16 and 19 are returned to the slanted up position there are stop elements at the top edges to position the boards correctly. The first stop 35 is on the top of the sleeve board 27. A second stop 36 on top of the stationary board positions the board 16 and finally a stop 37 on the top of the board 16 positions the board 19. Thus, the several stops 35,36 and 37 serve the purpose to align the several separate boards in the same plane.

Figure 9:
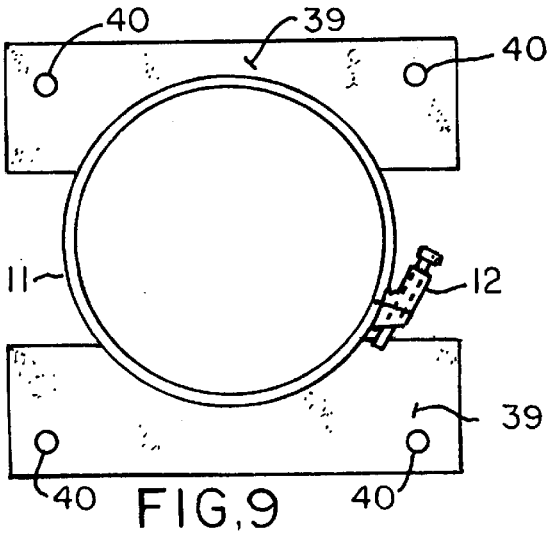
FIG. 9 is a plan view of a typical female hoop of adjustable size.

FIGS. 9 and 10 illustrate the female and male hoops which are seen in FIG. 1. As before noted the female hoop 11 is made to have an inner circumferential dimension so that as fabric gets thicker that hoop must be made large to allow the fixed dimension of the male hoop 38 to fit into the female hoop 11 and exert a tension in the fabric laid over the female hoop with sufficient tension in the fabric to allow the male hoop to reach an inset position. In order to allow the fabric and the hoops 11 and 38 to stay together and be removed from the hoop boards, the female hoop 11 is provided with mounting plates 39 with locating pins 40 which initially are inserted in the proper aperture 41 in the respective boards for that purpose which allows female hoop to fine positions on one or more boards in the aperture 41 shown in the view of FIGS. 1 and 2. The utility of the foregoing apparatus is to be understood as providing a frame F having a shaped surface over which fabric material may be fitted in preparation that the attachment of female and male embroidery hoops 11 and 38 respectively may be applied. The initial step in embroidery work, which may be applied to the fabric, which may be an article of clothing, a table cover or other fabric item, is to select a target area on the frame so the projections 40 on the female hoop 11 can be inserted in the selected aperture in the frame surface for support. The fabric may then be placed on or over the frame to cover the female hoop 11 in alignment with the target area. That mounting of the fabric is followed by adjusting the inner circumferential dimension of the female hoop by the sizing adjustment element 12 to suit the thickness of the fabric to allow the male hoop 38 to be press-fitted into the female and subject the fabric within the hoop to a desired tension so the embroidery machine can be satisfied.

While the invention has been described in connection with specific means, it should be understood that the description is made only by an example and is not intended to limit the scope of the invention as it may be defined by the scope of the following claims.

I claim:

1. Apparatus for framing embroidery areas on fabric material comprising:

a) a frame having a fabric shaping surface for removably supporting a fabric on which an embroidery work is to be applied, said frame surface being composed of a plurality of separate boards mounted on a common base;

b) a female embroidery hoop carried by said frame, boards to receive the fabric;

c) hinge means attached to certain of said separate boards to permit altering the area of the form shaping surface;

d) a male embroidery hoop adapted to fit in said female hoop for subjecting the fabric received over said female hoop to target the area for embroidery work; and e) releasable holding means on said female embroidery hoop permitting removal of said fabric with said female and male hoop engaged on the fabric material.

2. In apparatus for preparing fabric material to receive embroidery work, the combination comprising:

a) a base;

b) a plurality of fabric supporting boards mounted on said base and certain of said boards being hingedly connected to said base to lie in a common frame alignment;

c) a plurality of apertures arranged in said hingedly mounted boards in spaced apart relation;

d) at least one of said separate boards being held in a substantial fixed positions relative to said hingedly connected boards; said at least fixed position board is positioned in said common frame alignment with said plurality of hingedly mounted boards;

e) a first embroidery hoop removably mounted on said fabric supporting boards, and a second embroidery hoop adapted to fit within said first hoop and f) fabric to be embroidered positioned to be held between said first and second hoops under tension and removed with said first hoop from said plurality of boards for presentation to an embroidery machine.

3. The combination set forth in claim 2 wherein said first hoop is adjustable to permit said second hoop to fit into said first hoop with the fabric held in tension between said first and second hoops.

4. Embroidery framing apparatus for supporting fabric for embroidery work, the apparatus comprising:

a) a plurality of boards of varying placement from central to inner and outer positions, each having a pair of legs having spaced apart bottom ends and interconnection upper ends, said pairs of legs forming a common plane in which the legs of said central board are fitted to the leg of said inner board and said legs of said inner board are fitted to the leg of said outer board;

b) a support base for said plurality of said boards;

c) hinge means connecting said bottom ends of said inner and outer boards to permit said pair of legs to fit together selectively;

d) brace means on said support base in position to support said central board; and e) stop means on said boards in position to releasably retain said boards in a common place.

5. The embroidery framing apparatus set forth in claim 4 wherein said central board upper end has a shaped form, and each of said inner and outer boards has a shaped form substantially similar to said central board upper end.

6. The embroidery framing apparatus set forth in claim 4 wherein said upper ends of said central and inner ends have stop means to retain said plurality of boards in said common plane.

7. The embroidery framing apparatus set forth in claim 4 wherein said plurality of boards includes a hingedly mounted sleeve board connected to said central board for movement to project out of the plane of said boards, and stop means to limit the projection of said sleeve board.

* * * * *